United States Patent [19]

Thirion

[11] 4,231,243

[45] Nov. 4, 1980

[54] PIN TUMBLER LOCKS AND THEIR ASSEMBLY

[75] Inventor: André Thirion, Dijon, France

[73] Assignee: Antivols Simplex, France

[21] Appl. No.: 909,456

[22] Filed: May 25, 1978

[30] Foreign Application Priority Data

May 25, 1977 [FR] France ..... 77 15862

[51] Int. Cl.[2] ..... E05B 9/04; E05B 15/14; E05B 27/04

[52] U.S. Cl. ..... 70/364 A; 70/373; 70/378

[58] Field of Search ..... 70/364 A, 373, 37 B, 70/392

[56] References Cited

U.S. PATENT DOCUMENTS

| | | | |
|---|---|---|---|
| 3,673,831 | 7/1972 | Nelson | 70/373 |
| 4,094,175 | 6/1978 | Pechner | 70/364 A |

*Primary Examiner*—Robert L. Wolfe
*Attorney, Agent, or Firm*—Holman & Stern

[57] ABSTRACT

A tumbler lock is disclosed comprising a body and a cylindrical plug having an axial key passage rotatably mounted in the body. The plug and the body have aligned radial holes containing respective sets of tumblers, the tumblers in the body holes being spring urged toward the plug. The holes in the body have an outer conically tapering portion into which the respective tumblers are wedged prior to assembly of the lock and during assembly the tumblers are pressed out of these conical portions by a tool inserted into an opening in the body.

7 Claims, 4 Drawing Figures

Figure 1:
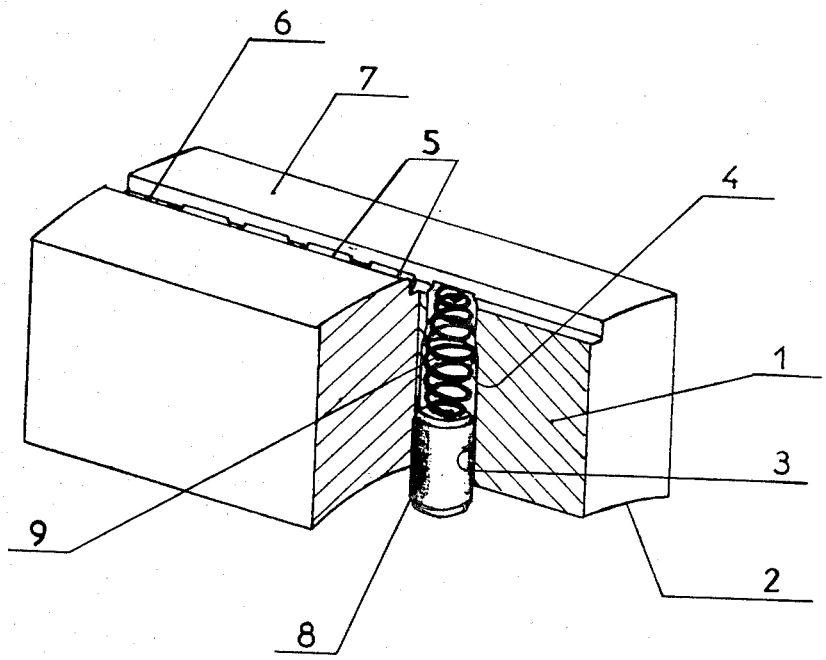

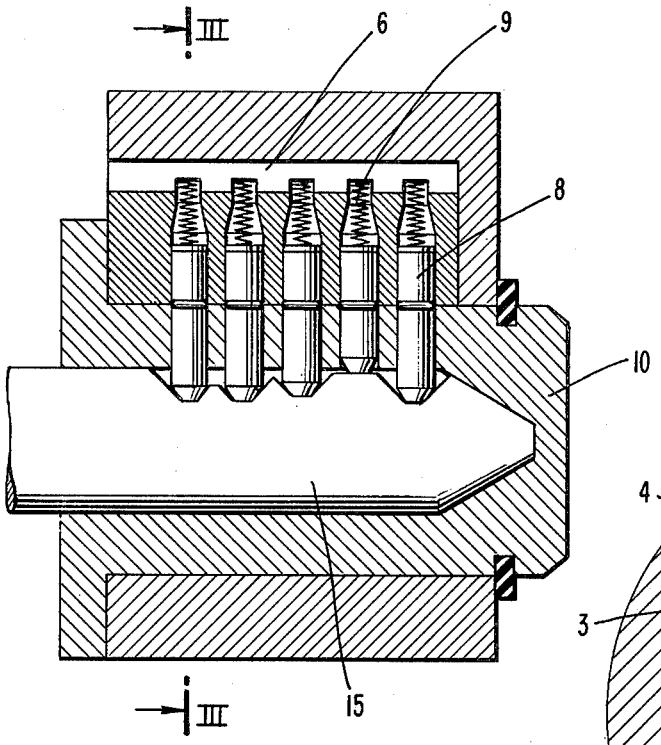
FIG. 2
FIG. 3
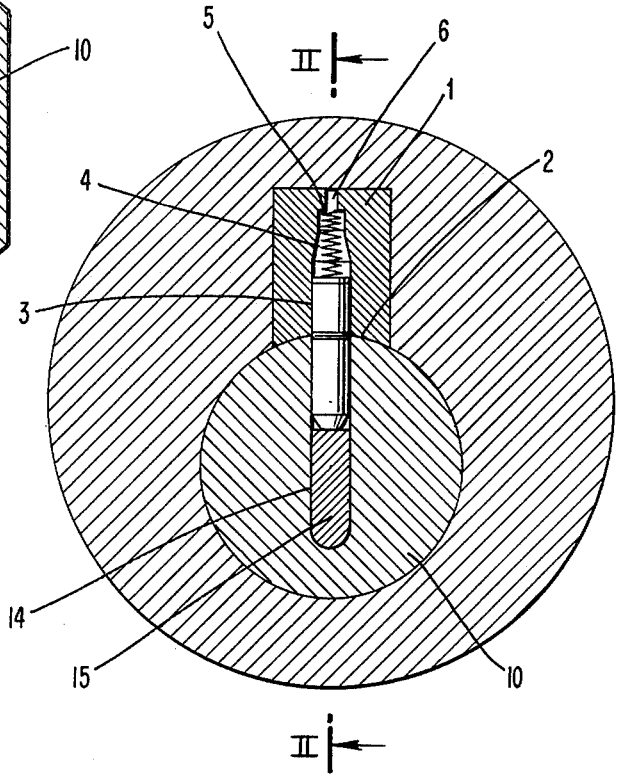
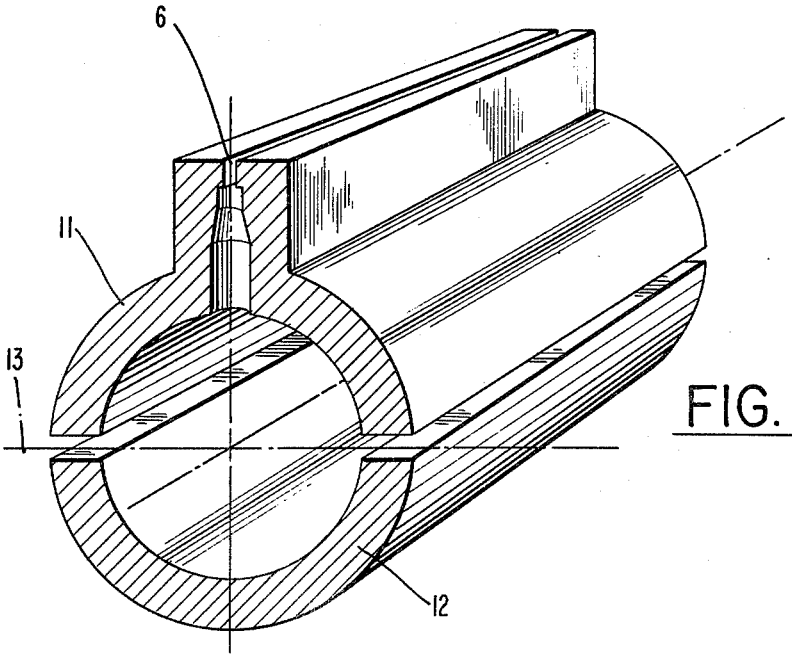
FIG. 4

PIN TUMBLER LOCKS AND THEIR ASSEMBLY

The invention relates to a pin tumbler lock comprising a body having an axial cylindrical bore in which a cylindrical plug is mounted for rotation, the plug having an axial key passage and a plurality of axially aligned radial holes opening into the said key passage and the peripheral surface of the plug, a pin tumbler sliding in each of the said radial holes, the body having a plurality of axially aligned radial holes opening into the said axial hole, a pin tumbler being biased towards the plug by means of a spring and being slidably mounted in each of the radial holes in the body.

To permit assembly of the pin tumblers in the body, it is known to form the radial holes in the body so that the holes extend to the periphery of the body so as to be accessible from the outside after assembly of the plug. The springs are then inserted in the holes and the radial holes in the body are closed by a plate against which the springs rest. This assembly is complicated and costly and does not permit separate preparation of the plugs and the complete bodies, which results in serious synchronization problems in assembly and storing lines.

The present invention aims at eliminating the use of a closing plate thereby making it possible to separately assemble and store the plugs and the bodies.

To this end, in the lock according to the invention the radial holes in the body have a cylindrical portion adjacent to the axial hole, which portion is prolonged by a conical portion narrowing towards the periphery of the said body, the said conical portion communicating with the periphery of the body.

To assemble the lock according to the invention, the springs and the pin tumblers are inserted in their respective radial holes in the body starting from the inner end of the body, the said pin tumblers are then forced until they are wedged in the said cylindrical portion, the plug with its tumblers is positioned and the tumblers of the body are freed by introducing a tool in the holes containing the tumblers through the outer periphery of the body.

To facilitate insertion of the tumblers, it is possible to form, in a known manner, the radial holes in the body in a separate longitudinal segment located in a hole in the body opening into the axial hole at the outer periphery of the body.

With this arrangement the body is assembled by preparing a sub-assembly comprising the said segment, the tumblers and the springs of the body and the said sub-assembly is mounted on the body.

In a variant, the body may comprise two identical shells joined along a substantially axial plane which does not pass through the radial holes in the body.

The invention will be better understood from the following description with reference to the accompanying drawing which FIG. 1 is a perspective view with parts cut away of a segment of the body of a lock according to an embodiment of the invention, FIG. 2 is a longitudinal section of a lock, FIG. 3 is a section on line III—III of FIG. 2 and FIG. 4 is a perspective view of an alternative form of lock body.

In the illustrated embodiment of FIGS. 1 to 3, the body has in a known manner radial holes opening into the axial hole in which the plug 10 is mounted for rotation and into the outer periphery of the body the plug having an axial key passage 14 for key 15. A longitudinal segment 1 of the body is positioned and held in the hole by any suitable means. The member 1 comprises an end surface 2 which is a prolongation of the internal surface of the axial hole of the body. The surface 2 is formed with axially aligned radial holes each of which comprises, starting from the surface 2, a cylindrical portion 3, a conical portion 4 narrowing towards the outside, and a hole 5 opening into a axial groove 6 in the outer surface 7 of the member 1. Each hole locates a pin tumbler 8 biased towards the outside by a spring 9 resting on the bottom of the hole.

During assembly, the springs 9 and then the tumblers 8 are inserted in a respective hole in the surface 2 of the member 1. The tumblers 8 are forced in their holes until their inner ends wedge against the walls of the conical portions 4. In this way, a sub-assembly is obtained which can be stored as such and then mounted in the lock body. After positioning of the plug, the tumblers are freed by exerting pressure against their outer end by means of a tool inserted through the holes 5. The tool can be a comb having as many teeth as radial holes in the body so as to simultaneously free all the tumblers 8 in the lock body.

FIG. 4 shows an alternative form of lock body made for use in the invention and which comprises two shells which are attached together along a plane 13 which does not pass through the radial holes formed in shell 11.

What we claim is:

1. A tumbler lock comprising a body having an axial cylindrical hole in which a cylindrical plug is mounted for rotation, the plug comprising an axial key passage and a plurality of axially aligned radial holes opening into the said key passage and into the peripheral surface of the plug, a tumbler slidably mounted in each of the said radial holes, the body comprising a plurality of axially aligned radial holes opening into the said axial hole, a further tumbler biased towards the plug by means of a spring sliding in each of the radial holes of the body, each of said radial holes in the body having a cylindrical portion adjacent to the axial hole and a conical portion extending from said cylindrical portion and narrowing towards the periphery of the said body, said conical portion communicating with the exterior of the body and being dimensioned for having the associated further tumbler wedged therein.

2. A lock as claimed in claim 1, in which the radial holes in the body are formed in a longitudinal body segment located in a gap in a further body portion which gap opens into the axial hole.

3. A lock as claimed in claim 1, in which the body comprises two shells attached to each other along a substantially axially extending plane which does not pass through the radial holes of the body.

4. A lock as claimed in claim 1, characterized in that to assemble the lock the springs and then the tumblers are inserted in their respective radial holes in the body starting from the inner surface of the body, the said tumblers are forced in until they are wedged in the said conical portion, the plug with its tumblers is placed in position and the tumblers in the body are freed by inserting a tool in the holes containing the tumblers starting from the outer periphery of the body.

5. A lock according to claim 2, in which to assemble the lock a sub-assembly is formed which comprises the said segment, the tumblers and the springs of the body and the said sub-assembly is mounted in the body.

6. A lock as claimed in claim 4, in which said tool is a comb having a number of teeth equal to the number of radial holes in the body.

7. A body for a pin tumbler lock, having an axial cylindrical hole for receiving a cylindrical plug, a plurality of axially aligned radial holes opening into the axial hole, tumblers in each of the radial holes biased towards the axial hole by respective springs, the radial holes each having a cylindrical portion adjacent to the axial hole and a conical portion extending between the cylindrical portion and the outer periphery of the body said conical portion being dimensioned to have the associated tumbler wedged therein.

* * * * *